United States Patent [19]

Vallance

[11] Patent Number: 4,604,929

[45] Date of Patent: Aug. 12, 1986

[54] SELF-ALIGNING GUILLOTINE

[75] Inventor: Leslie Vallance, Livingston, Scotland

[73] Assignee: Burroughs Corporation, Detroit, Mich.

[21] Appl. No.: 696,756

[22] Filed: Jan. 31, 1985

[30] Foreign Application Priority Data

Mar. 22, 1984 [GB] United Kingdom ..... 8407453

[51] Int. Cl.[4] ..... B26D 5/16

[52] U.S. Cl. ..... 83/524; 83/628; 83/636; 83/658; 83/582

[58] Field of Search ..... 83/31, 69, 71, 542, 83/139, 524, 582, 547, 658, 821, 854, 636, 925 CC, 694, 697

[56] References Cited

U.S. PATENT DOCUMENTS 1,357,727 11/1920 Roach ..... 83/582
2,149,913 3/1939 Gilpin ..... 83/31 X
2,450,312 9/1948 Tollison ..... 83/139 X

*Primary Examiner*—E. R. Kazenske
*Assistant Examiner*—John L. Knoble
*Attorney, Agent, or Firm*—Mark T. Starr; Kevin R. Peterson

[57] ABSTRACT

A guillotine assembly is provided wherein a blade is insertable between two halves of an anvil to cut a paper web. The blade is provided with teeth which engage triangular grooves in a resilient member of the anvil which is pressed against a rigid anvil plate. Points on the teeth first penetrate the web. Thereafter, tooth mid-sections form a series of slits in the web. Thereafter, points of contiguity between the teeth jam the slits to sever the web. The teeth each enter one of the grooves in the resilient member for the points of contiguity to engage and displace the resilient member in the final stage of cutting.

30 Claims, 13 Drawing Figures

SELF-ALIGNING GUILLOTINE

BACKGROUND OF THE INVENTION

1. Field of the Invention

The present invention relates to an apparatus for severing a movable web which passes adjacent thereto. More particularly, the present invention relates to a guillotine for making transverse cuts through a printed paper web. In greatest particularity, the present invention relates to a guillotine where a cutting blade is uniformly advanced towards and retracted from the web it is to cut and where the blade is substantially self-aligning with its associated anvil.

The invention is hereinafter described with reference to its use in the cutting of a moving paper web after that web has been printed on an electrically operated printer in an autoteller for providing a bank customer with a written record of a transaction. This application is given only by way of example and the present invention is applicable in any circumstance wherein a web of any severable material passes adjacent to a guillotine.

2. The Prior Art

It is known to provide a guillotine for cutting a movable paper web wherein a cutting blade is advanced towards the paper web to urge the paper web against a supporting anvil for the blade to pass through the paper web into a slot in the anvil and thereby sever the web. It is further known to provide that the leading edge of the blade is provided with a plurality of pointed teeth placed adjacent to one another in linear array. The points of the teeth first penetrate the paper web, the midsections of the teeth then enlarge the penetration holes into slits parallel to the blade, and thereafter the final through passage of the blade causes the slits to join and become a single complete scission of the web. It is further known to grind a chisel edge onto the teeth on the leading edge of the blade to facilitate the ease of penetration of the teeth into the web.

The blade, in passing into the slot in the anvil, must be in close alignment therewith. It is necessary to ensure that the paper web is well supported and that the slot in the anvil is narrow or else the paper will merely be pushed into the slot by the blade rather than being cut. The blade is made of very thin material and any misalignment between the narrow slot in the anvil and the blade causes the blade to collide with the anvil. Such collisions cause mechanical damage necessitating the complete replacement of the guillotine or, at very least, of the blade. It is known to provide the blade and/or the anvil with thin shims along the length of the blade or the anvil to position the blade within a few thousandths of an inch in parallel opposition to the slot. This precision manufacture is costly and slow. The risk of damaging the blade if it is advanced while not in alignment with the slot makes assembly and servicing very difficult. The necessity for grinding many faces on the teeth of the leading edge of a blade makes the cost of the blade and its replacement very high indeed. The necessity for close alignment between the blade and the slot in the anvil limits the amount of bowing permissible in the blade which in turn limits the possible length of the blade so that only relatively narrow paper webs can be so cut.

It is, therefore, desirable to provide a guillotine for cutting a web wherein the requirement for precision in alignment between the blade and the slot in the anvil is relaxed. It is further desirable to provide such a guillotine where the blade is not damaged if advanced when out of alignment with the slot. Yet further, it is desirable to provide such a guillotine wherein the blade is formed without the necessity for grinding chisel edges in the leading edge thereof.

SUMMARY OF THE INVENTION

The present invention consists in an apparatus for severing a movable web, said apparatus comprising: a blade, movable towards said web on a first face of said web for a cutting portion of said blade to be passed through said web to sever said web; and an anvil in opposition to said blade for engaging and supporting said web on a second face of said web when said web is urged thereagainst by said blade, said anvil comprising an opening for accommodating said cutting portion of said blade and said anvil being co-operative with said blade to support said web against the cutting action of said blade; where a boundary of said opening is defined by an edge of a resilient elastic member, where a face of said resilient elastic member is operative to assist in the support of said second face of said web, and where said cutting portion of said blade is operative to displace said edge of said resilient member to allow ingress of said cutting portion of said blade into said opening despite any misalignment between said blade and said opening.

BRIEF DESCRIPTION OF THE PREFERRED EMBODIMENT

In a preferred embodiment, an autoteller is provided with a guillotine for severing customer records which have been printed by a printer on a roll of paper. A toothed blade is reciprocally movable towards and through the printed paper web which in turn is supported by an anvil. One half of the anvil consists in an elastic resilient member. The resilient member is preferably a polyurethane moulding. One side of the opening wherein the blade is to enter is defined by an edge of the resilient member. When the blade enters the opening, it displaces the resilient member as it cuts the paper permitting a damage-free cutting action despite misalignment between the blade and the opening.

The resilient member is provided with a plurality of grooves, one groove for accommodating each of the plurality of teeth on the blade. In perfectly aligned operation, the blade does not deflect the resilient member until the material of the resilient member intermediate between the grooves engages the contiguous bases of the teeth on the blade. The grooves are vaulted such that, in misaligned operation, the teeth engage the edge of the groove to displace the resilient member at an early stage.

The blade is provided with a chisel edge. The chisel edge is made by a photo-etching process which includes the stages of laying down a pattern of photoresist on a tempered steel blank on one surface only and thereafter etching the entire blank for the rate of etching on one surface to exceed the rate of etching on the other surface to thereby leave a sloping chisel edge on the finally formed blade.

In the preferred embodiment, the blade is mounted on a support plate driven by an electric motor through an eccentric cam to execute single reciprocal movement on demand. In the preferred embodiment, there is provided a guide for the through-passing paper web, the tops of the guide being adapted to support the blade in its reciprocal path towards and through the paper web.

BRIEF DESCRIPTION OF THE DRAWINGS

The present invention is further described by way of an example by the following description in conjunction with the appended drawings in which.

DETAILED DESCRIPTION OF THE PREFERRED EMBODIMENT

Figure 1:
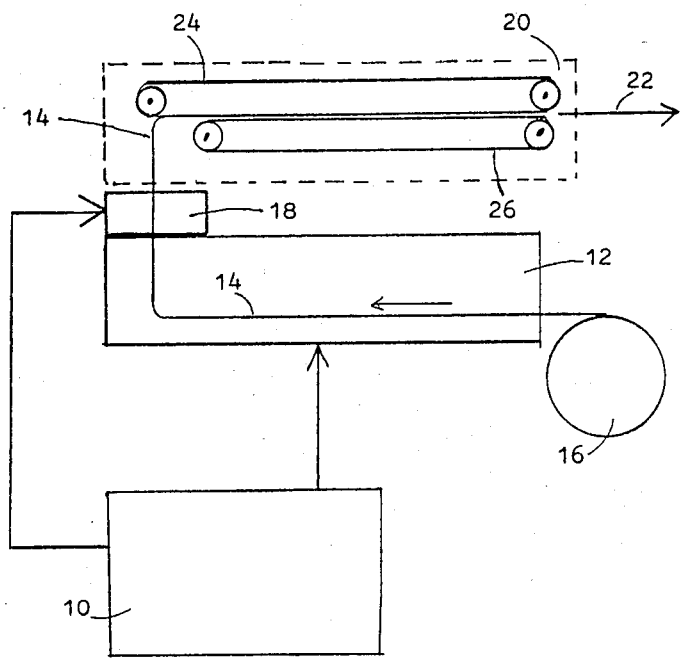
FIG. 1 shows an exemplary system wherein the preferred embodiment of the present invention can be incorporated.

FIG. 1 shows the field of application of the preferred embodiment of the present invention.

An autoteller, otherwise called a cash dispenser, is controlled by a central processor 10. The central processor controls a printer 12 which prints a record of a customer transaction on a movable paper web paid out from a paper supply reel 16.

Having been printed, the paper web 14 passes through a guillotine assembly 18 which is also controlled by the central processor 10. It is the guillotine assembly 18 which is the subject of the present invention. The central processor 10 can command the guillotine assembly 18 to perform a single severing action upon the movable paper web 14 whenever the printed customer record has passed through the guillotine assembly 18. The printed paper record having passed through the printer 12 and the guillotine assembly 18 is seized by a record conveyor 20 which conveys the record out of the autoteller through a slot to the customer as indicated by the arrow 22. The document conveyor comprises a pair of opposed belts, each of the pair of belts passing over driven cylinders, an upper belt 24 overhanging the guillotine assembly 18 to seize the leading edge of the paper web 14 exiting the guillotine 18 to duct the paper web 14 between itself and a lower belt assembly 26.

This application of the guillotine assembly 18 is by way of example only. The guillotine assembly is equally applicable to any equipment wherein a moving web 14 must be cut. As an example, the guillotine assembly 18 as hereinafter described may be used in point of sale terminals and cash registers for providing a customer receipt. The guillotine assembly may also be used in any computer controlled printing machinery. The present invention may equally be applied to cutting thin plastic and metallic sheets.

Figure 2:
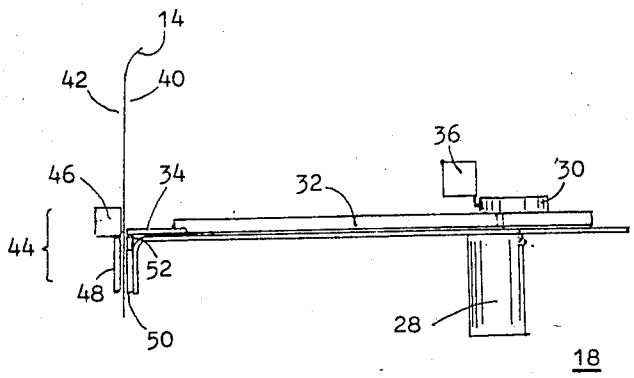
FIG. 2 shows a cross-sectional view of the guillotine assembly according to the preferred embodiment.

FIG. 2 shows a cross-sectional view of the guillotine assembly 18 of FIG. 1. An electric motor 28 drives an eccentric cam 30 through-penetrative of a support plate 32. The support plate 32 holds a blade 34 at the end thereof remote from the electric motor 28. A micro-switch 36 senses the angular position of the eccentric cam 30 to switch off the supply to the electric motor 28 whenever the cam 30 has executed a single revolution. The support plate 32 is driven in a single reciprocal motion towards the movable paper web 14 by means of providing power to the electric motor 28 under command from the central processor 10 until such time as the micro-switch 36 disengages the eccentric cam 30. Thereafter, the microswitch 36 continues to supply electrical power to the motor 28 until such time as the eccentric cam 30 once more engages the micro-switch 36 to disconnect power from the motor 28. The micro-switch 36 is engaged by the cam 30 whenever the blade 34 is withdrawn to an extremity of movement away from the movable paper web 14. The eccentric cam 30 provides sufficient movement of the support plate 32 to urge a cutting portion of the blade 34 right through the movable paper web 14.

The supporting plate 32, the electric motor 28 and the cam 30, are all mounted upon a base plate 38. The blade 34 engages a first face 40 of the movable paper web 14. The blade 34 urges a second face 42 of the movable paper web 14 against an anvil 44 consisting in a resilient member 46 abutting a rigid anvil plate 48. The resilient member 46 is urged against the rigid anvil plate 48. The resilient member can be mounted in any way suitable. Whilst not shown in FIG. 2, it is preferred that the resilient member 46 is attached to a mounting plate, the mounting plate being adjustable such that the resilient member 46 is proximate to but does not overhang the rigid anvil plate 48.

A guide plate 50 is affixed to the base plate 38 beneath the blade 34. The guide plate 50 and the rigid anvil plate 48 together form a guide channel to guide the movable paper web 14 therebetween through the guillotine assembly. The upper edge 52 of the guide plate 50 also serves to support the blade 34 in its passage through the web 14 between the resilient member 46 and the rigid anvil plate 48. The upper edge 52 of the guide plate 50 serves to direct the blade 34, which is to some extent flexible, when penetrating the web 14, to be proximate to but not in collision with the rigid anvil plate 48.

It is to be appreciated that the manner of driving of the blade 34 shown in FIG. 2 is merely exemplary. An electric motor 28 can be made to drive the support plate 32 using belts, pulleys, gears or the like in place of the eccentric cam 30. By the same token, solenoid drive may be used together with one or more springs to cause the blade 34 to penetrate the web 14. The only reguirement for the operation of the present invention is simply one of having the blade 34 being able to progress towards the web 14 to engage the web, penetrate the web and return thereafter to its original starting position.

Figure 3:
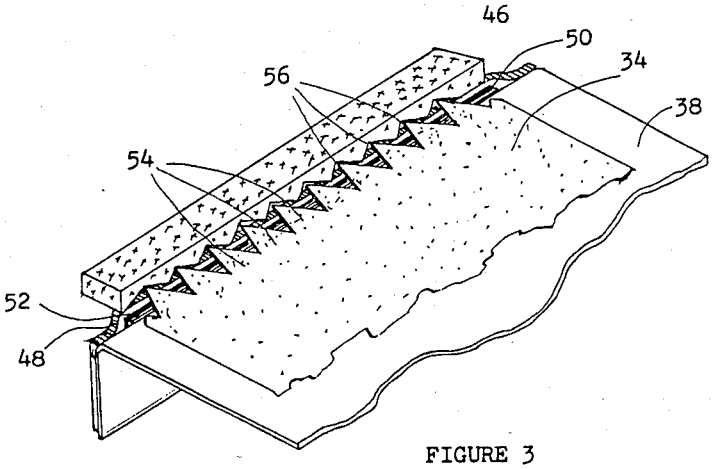
FIG. 3 shows a projected view of the relative disposition of the blade and the resilient member of the anvil.

FIG. 3 shows a projected view giving detail of the relative dispositions of the blade 34, the base plate 38, the resilient member 46, the rigid anvil plate 48, and the guide plate 50. The blade 34 is shown partway along its movement into the anvil 44. The blade 34 comprises a plurality of triangular teeth 54 linearly arrayed in contiguity one with another along the leading edge of the blade 34. The teeth 54 of the blade 34 are in part supported by the base plate 38 and in part supported by the upper edge 52 of the guide plate 50. The teeth 54 and the blade 34 are directed between the resilient member 46 and the upper edge of the rigid anvil plate 48. As will be later described, the resilient member 46 comprises a plurality of grooves 56 with which the teeth 54 engage.

Figure 4A:
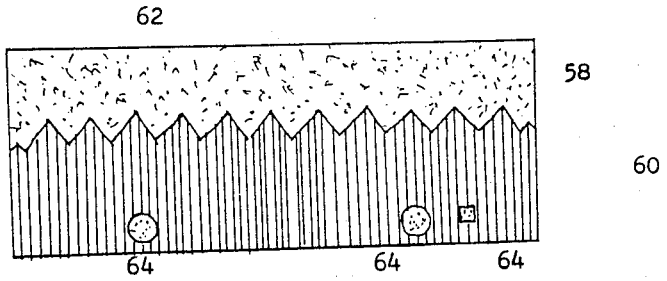
FIG. 4A shows the manner of laying down a pattern of photoresist on a tempered steel blank to manufacture the blade shown in FIG. 3.

FIG. 4A shows the first stage in the fabrication of the blade 34. A tempered steel blank 58 has a layer of photoresist 60 deposited and cured thereon to give the overall outline for the blade 34. The photoresist is first coated as an uncured layer upon a first surface 62 of the tempered steel blank 58. Those areas of the photoresist which are to be cured are then exposed to a light pattern defining the shape of the blade 34 which is to be made. The uncured photoresist is then cured in those areas which have been exposed to the light pattern. Uncured photoresist is washed away leaving on the cured layer of photoresist 60 on the first face of the tempered steel blank 58. The defined pattern of photoresist may also include mounting and orientation holes 64 to locate the blade 34 in a predetermined orientation, the necessity for which will later become apparent, on the support plate 32.

Figure 4B:
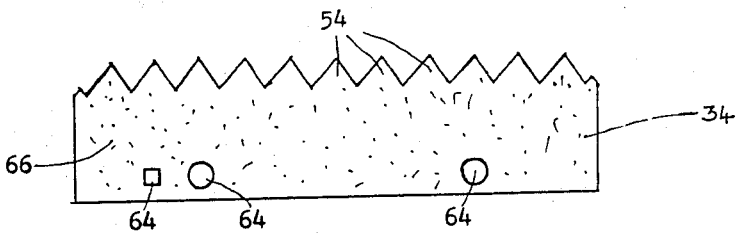
FIG. 4B shows a plan view of the finished blade of FIG. 4A.

FIG. 4B shows a plan view of the completed blade 34 viewed from a second face 66. The blade comprises a plurality of teeth 54 as earlier described. The part of the metal blank 58 not protected by the photoresist layer 60 on either side 62, 66 is completely eaten through. Where the photoresist layer 60 has been deposited etching from the first face of the blank 58 has been inhibited. A residual metal blade 34 remains in the shape of the photoresist outline 60 shown in FIG. 4A. The etching process can be achieved using any corrosive liquid chemical which will react with the substance of the tempered steel blank 58 but which will not dissolve the layer 60 of photoresist. With normal photoresist 60 any mineral acid in reasonable concentration will produce the desired result.

Figure 4C:
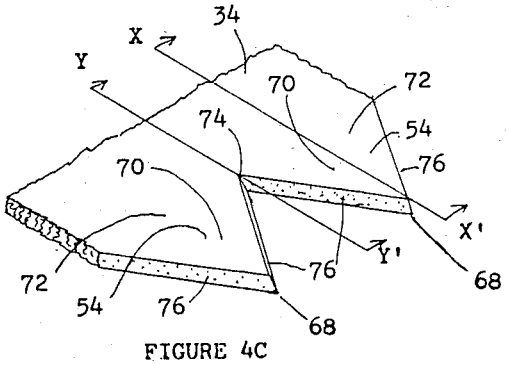
FIG. 4C shows detail of the teeth on the blade.

FIG. 4C shows detail of the teeth 54 of FIG. 4B. The teeth 54 comprise a leading point 68, a tapered mid-section 70 and a base 72. The bases 72 of adjacent teeth 54 come together at a point of contiguity 74.

The teeth 54 have a chisel edge 76 all around. The chisel edge extends to the leading points 68 and also to the points of contiguity 74. In use, the blade 34 is placed with the first surface 62 in contact with the base plate 38 and with the second surface 66 on the side of the blade 34 remote from the base plate 38.

Figure 4D:
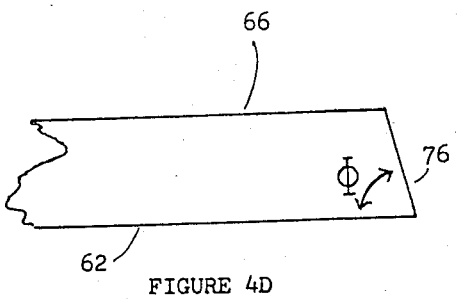
FIG. 4D shows the chisel edge of the blade.

FIG. 4D shows a view of the portion of the blade 34 shown in FIG. 4C taken along either of the lines X,X' or Y,Y' looking in the direction of the arrows. The cross-section is equally one which may be taken through the leading points 68 or through the points of contiguity 74. The chisel edge 76 slopes between the first surface 62 and the second surface 66 with an angle $\phi$ which approximates to 75°. The value of 75° is one purely of choice having regard to the strength of the paper web 14 and the elastic coefficient of the resilient member 46 with which the blade 34 is to be used. More or less acute angles may be used.

As an alternative method of manufacture of the blade 34 with a chisel edge 76, the second surface 66 of the steel blank 58 is coated with a photoresist layer which substantially is in opposition to the photoresist layer 60 shown in FIG. 4A but of slightly smaller dimension. When the blank 58 is etched a sloping chisel edge 76 is obtained whose angle $\phi$ is determined by the relative dimensions of the opposed photoresist layers 60. This second alternative method of manufacture of the blade 34 with a chisel edge 76 permits closer control of the angle $\phi$ of the chisel edge 76 relative to the first and second surfaces 62,66.

Figure 5:
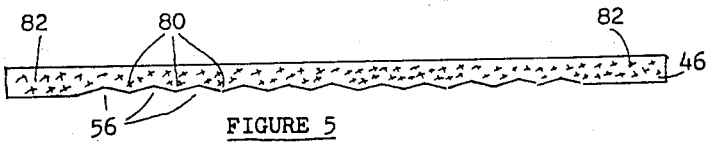
FIG. 5 shows cross-sectional detail of the resilient member viewed from the direction of approach thereto.

FIG. 5 shows a cross-sectional view of the resilient member 46 viewed from the direction of approach thereto of the blade 34. The resilient member 46 comprises a series of triangular grooves 56. The grooves 56 are in linear array along the length of the resilient member 46 and have the same spacing as the teeth 54 on the blade 34. The grooves 56 are separated one from another along the length of the resilient member 46 by small areas 80 of intermediate material. The grooves 56 extend only for the width of the blade 34. The resilient member 46 extends beyond the width of the blade 34 with ungrooved terminal portions 82 allowing for the mounting of the resilient member 46.

Figure 6:
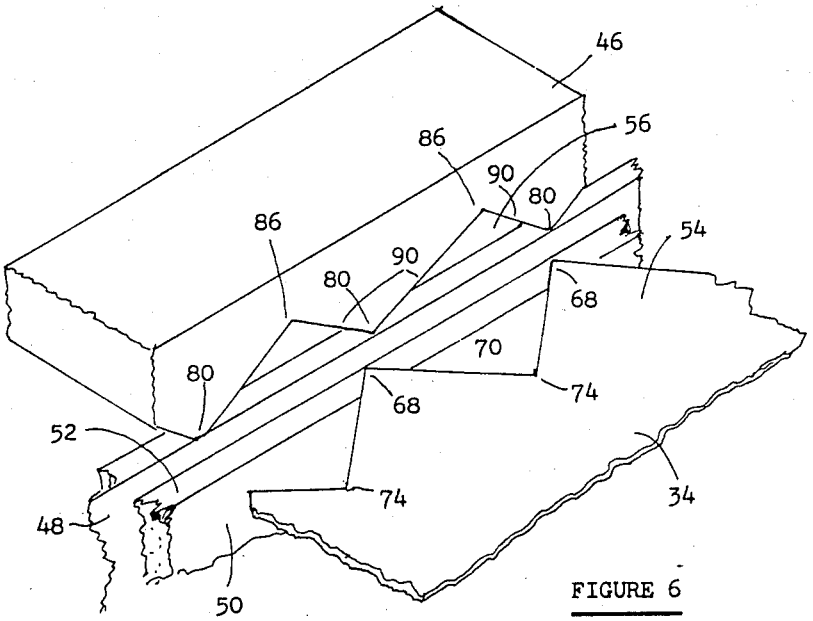
FIG. 6 is a projected view showing details of the manner of mutual engagement between the grooves in the resilient member and the teeth of the blade.

FIG. 6 shows a detailed projective view of the teeth 54 of the blade 34 in relation to the grooves 56 of the resilient member 46. In FIG. 6 the blade 34 is shown in its fully retracted position where the leading points 68 rest upon the upper edge 52 of the guide plate 50. It is to be understood that the paper web 14, not shown in FIG. 6, passes between the rigid anvil plate 48 and the guide plate 50. The resilient member 46 is pressed down under its own elastic restoring force against the upper surface 84 of the anvil plate 48. The leading points 68 are aligned in each instance with the apex 86 of each triangular groove 56. Thus, as the blade 34 advances towards the resilient member 46, the leading point 68 of each tooth 54 should pass directly beneath the apex 86 of each triangular groove.

It is intended that in operation the blade 34 should be in contact with the upper edges 52,84 respectively of the guide plate 50 and the rigid anvil plate 48. Thus, in perfect operation, the first contact which the resilient member 46 has with the blade 34 is when the areas of intermediate material 80 between the triangular grooves 56 contact the points of continguity 74 between the teeth 54. In those cases where operation is not perfect and where the blade 34, for reasons of mechanical distortion or misalignment, is not in contact with the upper surfaces 52,86 respectively of the guide plate 50 and the rigid anvil plate 48, the tapered mid-sections 70 of the teeth 54 contact the sloping edges 90 of the triangular grooves 78 before the areas of intermediate material 80 contact the points of contiguity 74 between the teeth 54. In normal, correctly aligned operation, it is the point of the contiguity 74 between the teeth 54 which, when slid beneath the areas of intermediate material 80 between the triangular grooves 56, creates a camming action to displace the resilient member 46 to allow progress of the blade 34 therebeneath.

As previously stated, in those cases of misalignment, the intermediate tapered mid-sections 70 of the teeth 54 first contact the sloping edges 90 of the triangular grooves 56 to begin the displacement of the resilient member 46 once again for the blade 34 to pass between the resilient member 46 and the rigid anvil plate 48 without damage to the blade 34 and, as will be apparent from later description, while successfully cutting the web 14.

Figure 7A:
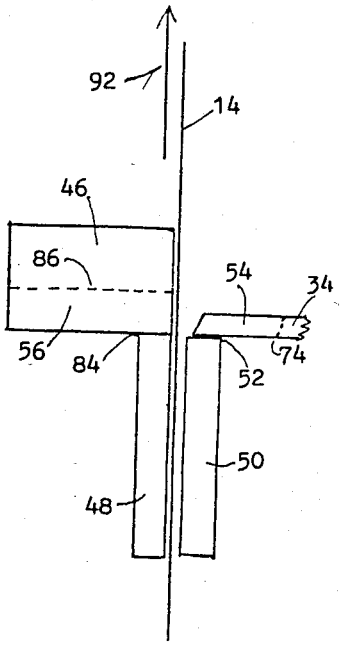
FIG. 7A shows a first stage in the cutting procedure of the guillotine.

FIG. 7A shows the first stage in the cutting of the web 14. The web 14 moves as indicated by the arrow 92. The web 14 has passed from the printer 12 and is on its way into the record conveyor 20. The blade 34 is shown in its fully retracted position. It remains in the fully retracted position, resting against the upper edge 52 of the guide plate 50, until the processor 10 has commanded the printer 12 to have completely printed the customer record and the processor 10 has waited for sufficient time for the whole of the printed record to have passed through the guillotine assembly 18. Thereafter the processor 10 commands the electric motor 28 to commence the cutting operation.

Figure 7B:
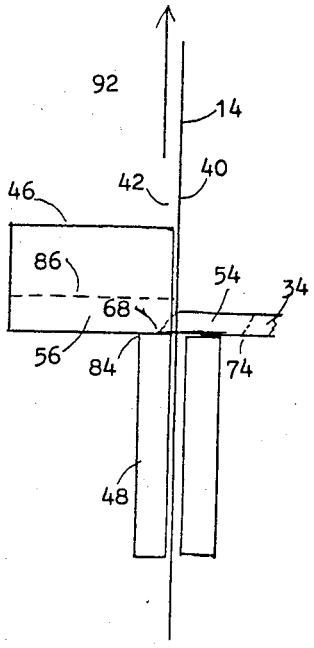
FIG. 7B shows the second stage in the cutting procedure of the guillotine wherein the leading points of the teeth penetrate the paper web.

FIG. 7B shows the first stage of the severing of the web 14. The blade 34 is advanced by the cam 30 for the leading points 68 of each tooth 54 to penetrade the web 14. Each leading point 68 makes its own hole. The chisel edge 76 assists in this penetration. The severing process is therefore commenced by the creation of a row of holes in the web 14. In creating the holes, the blade 34 was first advanced for the leading points 68 to engage the first face 40 of the web 14. The leading points 68 urge the web 14 against the anvil 46,48 for the second face 42 of the web 14 to engage the anvil 46,48 and be supported thereby. The leading points 68 then penetrate the web 14 from the first face 40 and begin to enter the triangular grooves 56. In so entering the triangular grooves 56, the leading points 68 are supported by the upper surface 84 of the anvil plate 48.

Figure 7C:
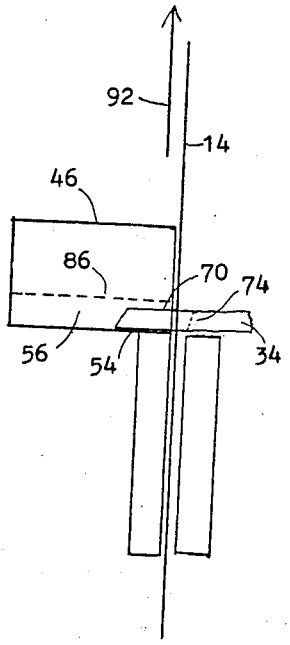
FIG. 7C shows a third stage in the cutting process where the tapered mid-sections of the teeth form enlarging slits in the paper web.

FIG. 7C shows the next stage in the severing process. The blade 34 continues to advance into the triangular grooves 56. The tapered mid-sections 70 of the teeth 54 enlarge the original puncture holes made by the leading points 68 of the teeth 54 and form a series of transverse slits across the web 14. The width of the slits increases with the degree of penetration of the blade 34 into the web 14.

Figure 7D:
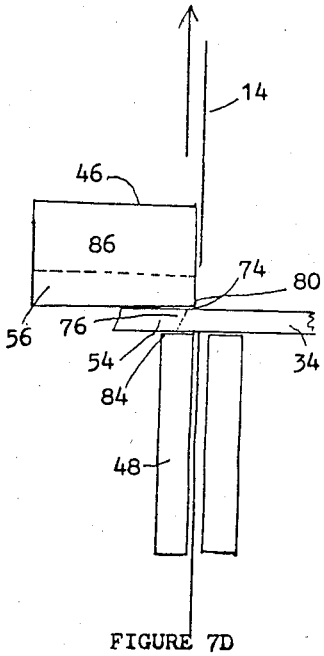
FIG. 7D shows the final stage in the cutting process were the blade passes right through the paper web to displace the resilient member.

FIG. 7D shows the last stage of the severing process. The blade 34 has penetrated through the web 14 to the point where the points of contiguity 74 between the teeth 54 have engaged the areas of intermediate material 80 between the triangular grooves 56. The intermediate material experiences a camming action by consequence of the chisel edge 76 at each point of contiguity 74. The resilient member 46 is therefore displaced under its own elastic restorative force from having contact with the rigid anvil plate 48 and its upper surface 84. The points of contiguity 74 punch through any residual material remaining between the slits formed in the action shown in FIG. 7C to cause the succession of slits across the web 14 to become a complete scission across the web 14.

As earlier stated, if the blade 34 advances towards the resilient member 46 and the web 14 while not in contact with the upper edge 52 of the guide plate 50, the tapered mid-sections 70 of the teeth 54 contact the sloping edges 90 of the triangular grooves 78 to commence the displacement of the resilient member 46 from the rigid anvil plate 48 at an earlier stage. The web 14 is still well supported against the anvil 46,48 so that cutting commences without folding the web 14 between the resilient member 46 and the anvil plate 48. At the extremity of movement of the blade 34 the points of contiguity 74 still meet the areas of intermediate material 80 to complete the cutting process.

I claim:

1. An apparatus for severing a movable web, said apparatus comprising: a blade, movable towards said web on a first face of said web for a cutting portion of said blade to be passed through said web to sever said web; and an anvil in opposition to said blade for engaging and supporting said web on a second face of said web when said web is urged thereagainst by said blade, said anvil comprising an opening for accommodating said cutting portion of said blade and said anvil being co-operative with said blade to support said web against the cutting action of said blade; where a first boundary of said opening is defined by an edge of a resilient elastic member, where a second boundary of said opening, opposing said first boundary, is defined by an edge of a rigid plate, where a face of said resilient elastic member is operative to assist in the support of said second face of said web, and where said cutting portion of said blade is operative to displace said edge of said resilient member to allow ingress of said cutting portion of said blade into said opening despite any misalignment between said blade and said opening.

2. An apparatus according to claim 1 wherein said resilient member is positioned so that it is urged against said edge of said rigid plate, wherein said cutting portion of said blade comprises a plurality of teeth linearly arrayed along a leading edge thereof, each of said teeth comprising a leading point, a tapered mid-section and a base where the base of each one of said plurality of teeth is contiguous with the base or bases of the tooth or teeth adjacent thereto, and wherein said edge of said resilient member defines the extremity of each of a corresponding plurality of grooves in said resilient member, each one of said plurality of grooves being adapted to receive a corresponding one of said plurality of teeth, where the points of contiguity between adjacent pairs of said plurality of teeth are operative to engage a corresponding portion of the material of said resilient member intermediate between the corresponding pair of said plurality of grooves for said displacement of said resilient member.

3. An apparatus according to claim 2 wherein each of said plurality of grooves is of triangular cross-section, wherein one side of said triangular cross-section in each instance is parallel to said rigid plate, and wherein in each instance said corresponding one of said plurality of teeth is introducible into said groove parallel to said rigid plate, where in the event of said blade not being operative to make contact with said rigid plate said each one of said plurality of teeth in each instance is operative to engage said edge in each respective one of said plurality of grooves to engage said edge with said mid-section to displace said resilient member prior to said points of contiguity between said teeth engaging said resilient member.

4. An apparatus according to claim 1 comprising a guide for directing said web between said blade and said anvil, said guide being adapted to support said blade in the passage of said blade towards said web.

5. An apparatus according to claim 1 wherein a guide is adapted to engage and support said first surface of said blade, wherein said web is a paper web, wherein said resilient member is a polyurethane moulding, and wherein said blade is a tempered steel blade.

6. An apparatus according to claim 1 comprising a support plate for holding said blade, an eccentric cam for driving said support plate in a reciprocal path toward and away from said web, and an electrical motor for rotating said eccentric cam, said electrical motor being operable to cause said eccentric cam to execute a single rotation for said support plate to execute a single passage through said reciprocal path for said blade to perform a single severing action upon said web.

7. An apparatus according to claim 2 comprising a guide for directing said web between said blade and said anvil, said guide being adapted to support said blade in the passage of said blade towards said web.

8. An apparatus according to claim 7 wherein a guide is adapted to engage and support said first surface of said blade, wherein said web is a paper web, wherein said resilient member is a polyurethane moulding, and wherein said blade is a tempered steel blade.

9. An apparatus according to claim 2 comprising a support plate for holding said blade, an eccentric cam for driving said support plate in a reciprocal path towards and away from said web, and an electrical motor for rotating said eccentric cam, said electrical motor being operable to cause said eccentric cam to execute a single rotation for said support plate to execute a single passage through said reciprocal path for said blade to perform a single severing action upon said web.

10. An apparatus according to claim 3 comprising a guide for directing said web between said blade and said anvil, said guide being adapted to support said blade in the passage of said blade towards said web.

11. An apparatus according to claim 10 wherein a guide is adapted to engage and support said first surface of said blade, wherein said web is a paper web, wherein said resilient member is a polyurethane moulding, and wherein said blade is a tempered steel blade.

12. An apparatus according to claim 3 comprising a support plate for holding said blade, an eccentric cam for driving said support plate in a reciprocal path towards and away from said web, and an electrical motor for rotating said eccentric cam, said electrical motor being operable to cause said eccentric cam to execute a single rotation for said support plate to execute a single passage through said reciprocal path for said blade to perform a single severing action upon said web.

13. An apparatus according to claim 1 wherein:

said blade includes a cutting portion comprising a plurality of teeth linearly arrayed along a leading edge thereof; and said edge of said resilient member includes a plurality of grooves.

14. An apparatus according to claim 13 wherein said plurality of grooves is at least as great in number as said plurality of teeth.

15. An apparatus according to claim 13 wherein each one of said plurality of grooves is adapted to receive a corresponding one of said plurality of teeth.

16. An apparatus according to claim 13 wherein each one of said plurality of grooves is of triangular cross-section.

17. An apparatus according to claim 16 wherein said triangular cross-section is in each instance parallel to said rigid plate.

18. An apparatus according to claim 17 wherein each one of said plurality of teeth is introducible into a corresponding one of said plurality of grooves.

19. An apparatus according to claim 18 comprising a support plate for holding said blade, an eccentric cam for driving said support plate in a reciprocal path towards and away from said web, and an electrical motor for rotating said eccentric cam, said electrical motor being operable to cause said eccentric cam to execute a single rotation for said support plate to execute a single passage through said reciprocal path for said blade to perform a single severing action upon said web.

20. An apparatus for severing a web, comprising:

blade means, movable towards and into engagement with a first face of said web, for cutting said web, said blade means including a plurality of teeth; and anvil means, opposing said blade means, for supporting a second face of said web and compensating for blade means misalignment, said anvil means including a resilient member, an edge of said resilient member defining a first side boundary of an opening in said anvil means, said opening for accommodating said blade means, said edge of said resilient member defining an extremity of each of a plurality of grooves in said resilient member.

21. The apparatus in accordance with claim 20 wherein each one of said plurality of grooves is adapted to receive a corresponding one of said plurality of teeth.

22. The apparatus in accordance with claim 20 wherein each of said plurality of grooves is of triangular cross-section.

23. The apparatus in accordance with claim 22 wherein one side of said triangular cross-section in each instance is coincident with said edge of said resilient member.

24. The apparatus in accordance with claim 23 wherein said anvil means further includes a rigid member, an edge of said rigid member defining a second side boundary of said opening.

25. The apparatus in accordance with claim 20 wherein said anvil means further includes a rigid member, a second boundary of said opening defined by an edge of said rigid member.

26. The apparatus in accordance with claim 25 wherein each of said plurality of grooves is of triangular cross-section.

27. The apparatus in accordance with claim 26 wherein one side of said triangular cross-section in each instance is parallel to the edge of said rigid member.

28. The apparatus in accordance with claim 26 further including a guide for directing said web between said blade means and said anvil means, said guide being adapted to support said blade means as it moves towards and engages said web.

29. The apparatus according to claim 25 wherein said blade means includes a blade, said guide adapted to engage and support a first surface of said blade as said blade means moves towards and engages said web.

30. The apparatus in accordance with claim 27 further including means for driving said blade means in a reciprocal path towards and away from said web, whereby said blade means severs said web.

* * * * *

UNITED STATES PATENT AND TRADEMARK OFFICE

CERTIFICATE OF CORRECTION

PATENT NO. : 4,604,929

DATED : August 12, 1986

INVENTOR(S) : Leslie Vallance

It is certified that error appears in the above-identified patent and that said Letters Patent are hereby corrected as shown below:

Col. 3, line 34, change "were" to --where--.
Claim 5, Col. 8, line 56, change "1" to --4--.
Claim 5, Col. 8, line 56, change "a" to --said--.
Claim 5, Col. 8, line 57, change "said" to --a--.
Claim 6, Col. 8, line 64, change "toward" to --towards--.
Claim 8, Col. 9, line 7, change "a" to --said--.
Claim 8, Col. 9, line 8, change "said" to --a--.
Claim 11, Col. 9, line 26, change "a" to --said--.
Claim 11, Col. 9, line 27, change "said" to --a--.

Signed and Sealed this

Eighteenth Day of November, 1986

*Attest:*

DONALD J. QUIGG

*Attesting Officer* *Commissioner of Patents and Trademarks*